US006435832B1

(12) United States Patent
Fasano

(10) Patent No.: US 6,435,832 B1
(45) Date of Patent: Aug. 20, 2002

(54) HUB ASSEMBLY

(75) Inventor: Julian B. Fasano, Englewood, OH (US)

(73) Assignee: Chemineer, Inc., Dayton, OH (US)

( * ) Notice: Subject to any disclaimer, the term of this patent is extended or adjusted under 35 U.S.C. 154(b) by 0 days.

(21) Appl. No.: 09/559,772

(22) Filed: Apr. 27, 2000

(51) Int. Cl.[7] ..... B63H 1/20

(52) U.S. Cl. ..... 416/204 R; 416/244 R; 416/244 A

(58) Field of Search ..... 416/244 R, 244 A, 416/204 R, 204 A, 146 A

(56) References Cited

U.S. PATENT DOCUMENTS

| | | | | |
|---|---|---|---|---|
| 2,811,339 A | | 10/1957 | Osborne et al. | |
| 3,494,708 A | * | 2/1970 | Nunlist et al. | 416/244 |
| 3,526,467 A | * | 9/1970 | Kime | 416/244 |
| 4,221,488 A | | 9/1980 | Nunlist et al. | 366/343 |
| 4,601,583 A | | 7/1986 | Amorese | 366/343 |
| 4,628,574 A | | 12/1986 | Lerman | 29/156.8 R |
| 4,722,608 A | * | 2/1988 | Salzman et al. | 366/330 |
| 5,152,606 A | * | 10/1992 | Borraccia et al. | 366/331 |
| 5,358,328 A | | 10/1994 | Inoue et al. | |
| 5,785,495 A | | 7/1998 | Springer et al. | 415/221 |
| 5,947,892 A | | 9/1999 | Benkowski et al. | 600/16 |
| 5,964,694 A | | 10/1999 | Siess et al. | 600/17 |

FOREIGN PATENT DOCUMENTS

| | | |
|---|---|---|
| DE | 2712124 | 9/1978 |
| FR | 2688276 | 9/1993 |
| GB | 1215057 | 12/1970 |
| GB | 1223521 | 2/1971 |
| GB | 2081117 | 2/1982 |

* cited by examiner

*Primary Examiner*—F. Daniel Lopez
*Assistant Examiner*—James M McAleenan
(74) *Attorney, Agent, or Firm*—Thompson Hine LLP

(57) ABSTRACT

An assembly for rotationally coupling a set of blades to a drive shaft. The assembly includes an sleeve rotationally coupled to the drive shaft, a cap rotationally coupled to the sleeve, and a lower ring located between the cap and the sleeve, the lower ring having a set of generally radially extending blades. The assembly further includes an upper ring located between the lower ring and the sleeve, the upper ring having a set of generally radially extending blades, wherein the upper and lower rings are rotationally coupled to at least one of the sleeve or the cap.

37 Claims, 2 Drawing Sheets

HUB ASSEMBLY

The present invention is directed to a hub assembly, and more particularly, to a hub assembly for attaching a set of blades to a drive shaft.

BACKGROUND OF THE INVENTION

Impellers are widely used as a component of an agitator assembly to mix various fluids.

An agitator assembly typically include a drive shaft with one or more impellers mounted to the drive shaft. Each impeller includes a plurality of blades of that are attached to one or more hubs, which are in turn coupled to the drive shaft. The blades of each impeller extend radially outwardly from the hub. Each hub and blade combination is located inside a vessel that is filled with a fluid to be mixed.

When an agitator assembly is used in sanitary applications, such as in the food, beverage or pharmaceutical industries, the vessels containing the fluids are closed. In order to install and service components of the agitator assembly, a manway (i.e. a sealable opening) is provided in the vessel. The manways are typically on the order of 24 inches in diameter, and many impellers are larger than the manway in the associated vessel. In these cases the impeller must disassembled such that each impeller component can fit through the manway. The impeller is then reassembled inside the vessel as it is attached to the drive shaft. In sanitary applications it is also desired to have an agitator assembly having relatively smooth outer surfaces with any voids, crevasses or dead spaces sealed from the fluid contents of the vessel.

SUMMARY OF THE INVENTION

The present invention is a sanitary hub assembly which can be easily attached to a drive shaft. In a preferred embodiment, the invention is an assembly for rotationally coupling a set of blades to a drive shaft. The assembly includes an upper locking hub rotationally coupled to the drive shaft, a lower locking hub rotationally coupled to the upper locking hub, and a lower ring located between the lower locking hub and the upper locking hub, the lower ring having a set of generally radially extending blades. The assembly further includes an upper ring located between the lower ring and the upper locking hub, the upper ring having a set of generally radially extending blades, wherein the upper and lower rings are rotationally coupled to the drive shaft.

Accordingly, it is an object of the present invention to provide a sanitary hub assembly which can be easily disassembled to fit through a manway and easily reassembled and attached to a drive shaft.

Other objects and advantages of the present invention will be apparent from the following description and the accompanying drawings.

DETAILED DESCRIPTION

Figure 1:
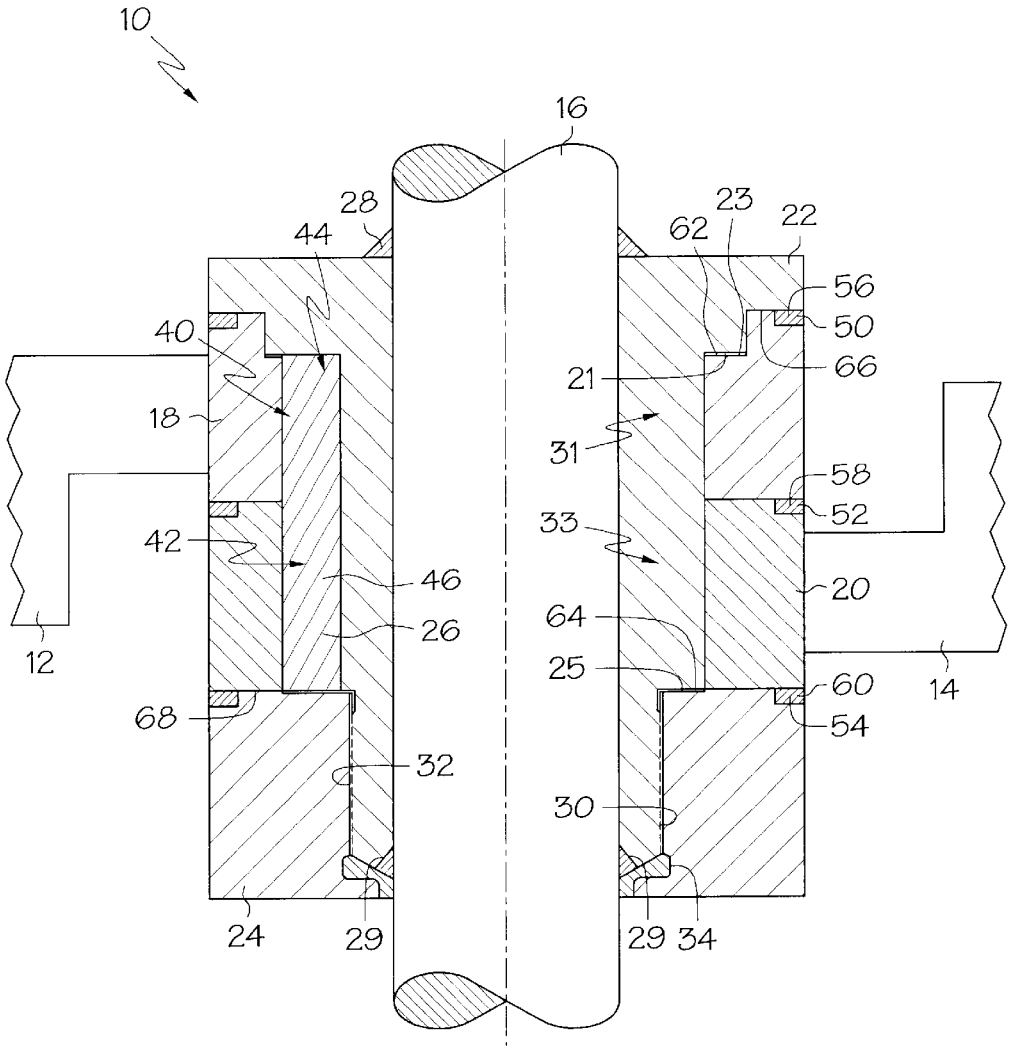
FIG. 1 is a side cross section of one embodiment of the hub assembly of the present invention.

As shown in FIG. 1, the hub assembly 10 of the present invention rotationally couples a first set of blades 12 and a second of lower blades 14 to a drive shaft 16 (only one of the first set of blades and one of the lower set of blades being shown in FIG. 1). The hub assembly 10 includes an upper ring 18, a lower ring 20, a sleeve 22 and a cap 24. The first set of blades 12 are coupled to, and extend generally radially outwardly from, the upper ring 18. Similarly, the second set of blades 14 are coupled to extend generally radially outwardly from the lower ring 20. Each set of blades 12, 14 are circumferentially spaced around their respective rings 18, 20. Typically, each ring 18, 20 includes two blades spaced about 180° apart.

The sleeve 22 is rotationally coupled to the shaft 16. In the illustrated embodiment, the 25 sleeve 22 is coupled to the drive shaft 16 by an upper weld 28 and a lower weld 29, although various other methods for coupling the sleeve to the drive shaft may be used. The sleeve 22 includes a threaded lower end 30 that extends axially beyond the upper and lower rings 18, 20, and the threaded end includes a set of male threads 32. The threaded lower end 30 extends through a pair of central holes 31, 33 located in the upper 18 and lower 20 rings, respectively.

The threaded cap 24 is threaded onto the male threads 32 of the sleeve 22.

A shaft seal 34 is located between the cap 24 and the sleeve 22 and between the cap 24 and the drive shaft 16. The threads on the cap 24 and the sleeve 22 are oriented such that the cap 24 is threaded onto the sleeve by rotating the cap in the opposite direction of the rotation of the drive shaft. This ensures that the resistance forces exerted on the cap 24 as the shaft 16 is rotated through the fluid (not shown) does not cause the cap to become unthreaded from the sleeve 22. Furthermore, because the cap 24 does not include any blades mounted thereon, it experiences only relatively low resistance forces when the shaft 16 is rotated, which reduces over tightening of the cap onto the sleeve 22.

The upper ring 18, lower ring 20 and sleeve 22 each include a keyway 40, 42, 44, respectively, and a key 46 is received in the keyways. In this manner, the key 46 rotationally couples the sleeve 22 to the upper and lower rings 18, 20

The radial outer surfaces of the sleeve 22, upper ring 18, lower ring 20 and cap 24 all have the same radius to provide a smooth outer surface for the hub assembly 10. Furthermore, the intersection of each of these components includes a seal to fill any voids or crevasses. For example, an upper seal 50 is located between the upper ring 18 and the sleeve 22, a middle seal 52 is located between the upper ring 18 and the lower ring 20, and a lower seal 54 is located between the lower ring 20 and the cap 24. The upper ring 18 includes an upper groove 56 to receive the upper seal 50, the lower ring 20 includes a middle groove 58 to receive the middle seal 52, and the cap 24 includes a lower groove 60 to receive the lower seal 54. However, it should be understood that the upper groove 56 may be located in the upper ring 18, the sleeve 22 or both the sleeve and the upper ring; the middle groove 58 may be located in the lower ring 20, the upper ring 18 or both the upper ring and lower ring; and the lower groove 54 may be located in the lower ring 20, the cap 24, or both the lower ring and cap.

The assembly of the hub assembly 10 is as follows: the sleeve 22 is first coupled to the shaft 16, typically by welds 28, 29. The upper ring 18 having the first set of blades 12 is then fit onto the sleeve 22, ensuring that the keyway 40 of the upper ring is radially aligned with the keyway 44 of the sleeve 22. Next, the lower ring 20 having the second set of blades 14 is located onto the sleeve 22, and the keyway 42 of the lower ring 20 is radially aligned with the keyway 44 of the sleeve 22. Next, the key 46 is slid through the keyways 40, 42, 44 and temporarily held in place. The cap 24 is then threaded onto the sleeve 22, thereby locking the upper and lower rings between the sleeve 22 and cap 24.

The sleeve 22 includes an upper notch 21 located at an upper radially inner portion of the sleeve, and the upper notch 21 receives a corresponding notch 23 of the upper ring 18. The notches 21, 23 are shaped such that a gap 62 is located between those components. Similarly, the lower radially inner portion of the sleeve 22 includes a lower notch 25. The lower notch 25 and the radially inner portion of the cap 24 are shaped such that a gap 64 is formed therebetween. Furthermore, the key 46 is slightly shorter than the keyway 44 in the sleeve, and is shorter than and the combined keyways 40, 42 in the upper and lower rings to maintain the gaps 62, 64. The gaps 62, 64 ensure that the seals 50, 52, 54 are properly compressed at the radially outward portions of the hub assembly 10.

For example, upper ring 18 engages the sleeve 22 at interface 66 to ensure that the upper 50 seal is properly compressed between the upper ring 18 and the sleeve 22. The gap 62 ensures that there is no interference between the upper ring 18 and sleeve 22 (i.e., at a radially inward location) that might interfere with the engagement at interface 66. Similarly, the gap 64 ensures that the lower ring 20 properly engages the cap 24 at the interface 68 immediately adjacent the lower seal 54. This helps to ensure that the seals 50, 52, 54 are properly compressed in the grooves 56, 58, 60. Furthermore, each seal 50, 52, 54 is preferably larger in its uncompressed state than the groove in which it is received. This ensures that the grooves 56, 58, 60 are properly sealed, and the seals 50, 52, 54 are properly compressed, to provide a sanitary impeller assembly.

Another advantage provided by the present invention is that the hub assembly 10 can be mounted at nearly any location along the shaft 16. Because the shaft 16 is passed through the hub assembly 10 and the hub assembly is not attached to an end of the shaft, the hub assembly can be mounted at any vertical location along the shaft. In this manner, additional hub assemblies (not shown) can be located above or below the hub assembly 10, if desired. Furthermore, because the hub assembly 10 need not be mounted onto an end of the shaft, the shaft need not be divided or cut into separate shaft components, which improves straightness tolerances, the strength of the shaft, and ease of assembling the hub assembly.

Figure 2:
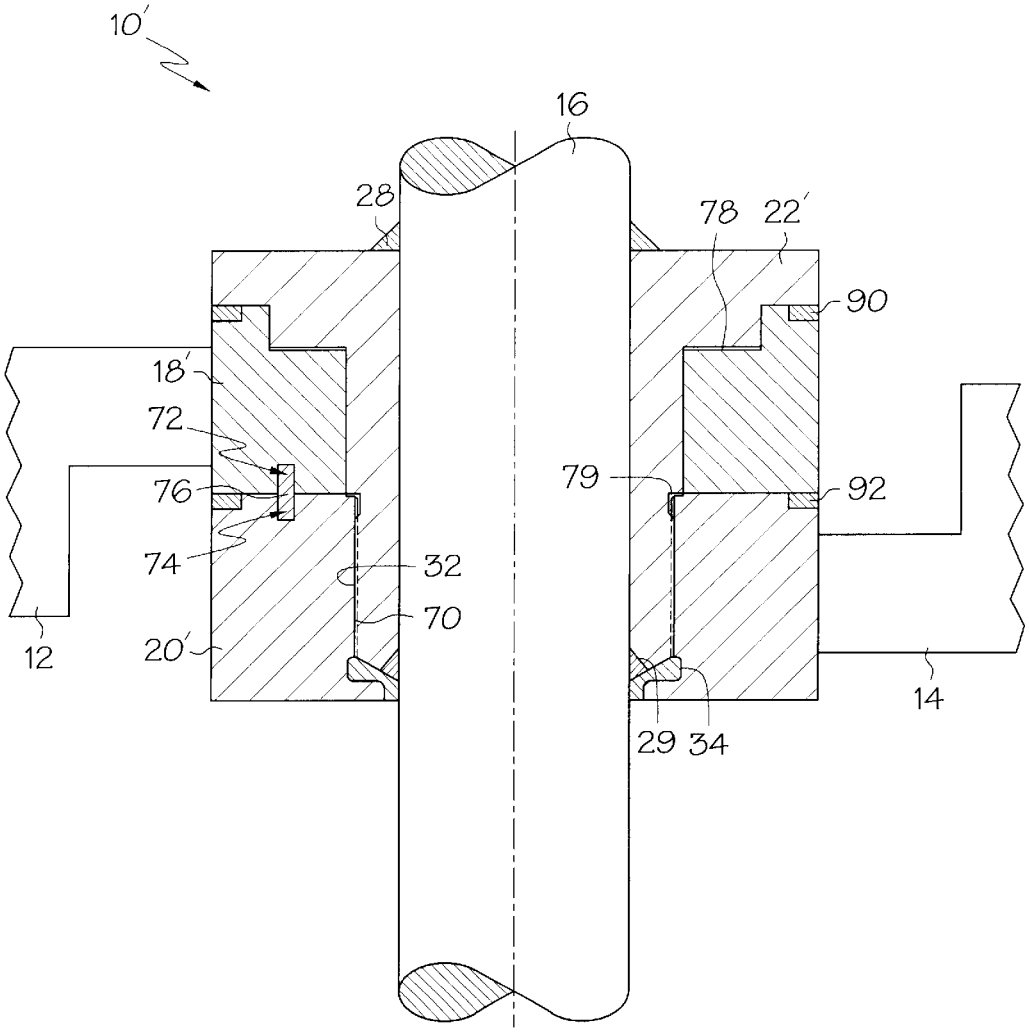
FIG. 2 is a side cross section of an alternate embodiment of the hub assembly of the present invention.

An alternate embodiment of the hub assembly is shown as hub assembly 10' in FIG. 2. In this embodiment, the threaded cap is not used; instead, the lower ring 20' includes a set of female threads 70 that engage the male threads 32 on the sleeve 22'. The upper (or inner) ring 18' and lower (or outer) ring 20' each include an axially-extending keyway 72, 74 and receive a key 76 therein to rotationally couple the upper ring 18' to the lower ring 20'. A gap 78 is maintained between the sleeve 22' and the upper ring 18' to ensure that the radially outward portions of the sleeve and upper ring are properly engaged, which helps the seals 90, 92 to properly seal the hub assembly 10'. The sleeve 22' and lower ring 20' are also shaped to include a gap 79 therebetween at a radially inner location of those components.

Various mechanisms for rotationally coupling the various components of the hub assembly together may be implemented without departing from the scope of the present invention. For example, various keys, pins, tongues/groove combinations, detent mechanisms and the like may be used to rotationally couple the components of the hub assemblies in place of the key/keyways and threaded arrangements. For example, the upper and lower rings 18, 20 may include interengaging geometries for rotationally coupling to each other. Furthermore, the upper ring 18 may be rotationally coupled to the lower ring 20, the sleeve 22 and/or the cap 24; the lower ring 20 may be rotationally coupled to the upper ring 18, sleeve 22 and/or cap 24. Furthermore, the keys disclosed herein may be separate components, or they may be integrally formed with any one of the sleeve, cap, lower ring or upper ring. Thus, the term "key" as used herein includes pins, tongues, grooves, detent mechanisms, interengaging geometries, or other methods for rotationally coupling at least two components.

Having described the invention in detail and by reference to the preferred embodiments, it will be apparent that modifications and variations thereof are possible without departing from the scope of the invention.

What is claimed is:

1. An assembly for rotationally coupling a set of blades to a drive shaft comprising:

a sleeve shaped to be rotationally coupled to said drive shaft and to receive said drive shaft therethrough;

a cap shaped to be rotationally coupled to said sleeve and to receive said drive shaft therethrough;

a lower ring shaped to be located between said cap and said sleeve, said lower ring having a set of generally radially extending blades; and an upper ring shaped to be located between said lower ring and said sleeve, said upper ring having a set of generally radially extending blades, wherein at least one of said upper and lower rings can be rotationally coupled to at least one of said sleeve or said cap.

2. The assembly of claim 1 further comprising a key rotationally coupled to said at least one of said sleeve or said cap and to said at least one upper or lower rings.

3. The assembly of claim 2 wherein said upper ring and said lower ring each include a keyway, and wherein said key is integral with said sleeve and is received in each keyway to rotationally couple said upper and lower rings to said sleeve.

4. The assembly of claim 2 wherein said lower ring, said upper ring, and said sleeve each include a keyway, and wherein said key is received in each keyway to rotationally couple said upper and lower rings to said sleeve.

5. The assembly of claim 2 wherein said at least one of said sleeve or said cap includes a keyway receiving said key therein and wherein said at least one of said upper or lower rings includes a keyway receiving said key therein.

6. The assembly of claim 5 wherein said keyways extend generally axially.

7. The assembly of claim 6 wherein said keyway in said at least one of said sleeve or said cap and said keyway in said at least one of said upper or lower ring are radially aligned.

8. The assembly of claim 2 wherein said sleeve is rotationally coupled to said key, and wherein said sleeve includes a central portion located radially inwardly of said upper and lower rings, and wherein said central portion includes a keyway to receive said key.

9. The assembly of claim 1 wherein said cap is threadingly coupled to said sleeve.

10. The assembly of claim 9 wherein said sleeve includes a lower threaded end extending axially beyond said upper and lower rings, and wherein said cap is threaded onto said lower threaded end.

11. The assembly of claim 1 wherein the radially outer surfaces of said cap, said sleeve and said upper and lower rings have about the same radius to form a generally smooth outer surface.

12. The assembly of claim 11 further including a lower seal located between said cap and said lower ring, a middle seal located between said lower ring and said upper ring, and an upper seal located between said upper ring and said sleeve.

13. The assembly of claim 12 wherein an outer surface of said assembly includes lower, middle, and upper grooves shaped to receive said lower, middle, and upper seals, respectively.

14. The assembly of claim 13 wherein each groove is slightly smaller than the uncompressed shape of its associated seal such that each seal is compressed when it is received in its associated groove.

15. The assembly of claim 12 wherein a radially inner portion of said sleeve is axially spaced away from a radially inner portion of one of said upper or lower rings to ensure proper compression of said seals at said outer surface of said assembly.

16. The assembly of claim 1 further comprising a lower hub seal located between said cap and said drive shaft.

17. The assembly of claim 1 wherein said sleeve is welded to said drive shaft to rotationally couple said sleeve to said drive shaft.

18. An assembly for rotationally coupling a set of blades to a drive shaft comprising:

a sleeve rotationally coupled to said shaft and receiving said shaft therethrough;

a unitary outer ring coupled to said sleeve and receiving said shaft therethrough, said outer ring having a set of generally radially extending blades; and a unitary inner ring located between said sleeve and said outer ring and receiving said shaft therethrough, said inner ring being directly rotationally coupled to at least one of said sleeve or said outer ring, said inner ring having a set of generally radially extending blades.

19. The assembly of claim 18 wherein said outer ring is threaded onto said shaft.

20. The assembly of claim 18 wherein said inner ring includes a central opening, and wherein said sleeve extends through said central opening in said inner ring.

21. The assembly of claim 18 wherein said outer ring and said inner ring each include a keyway, and wherein said assembly further includes a key received in said keyways to rotationally couple said outer ring and said inner ring.

22. The assembly of claim 21 wherein said keyway in said outer and inner rings extends generally axially.

23. The assembly of claim 18 wherein the outer surfaces of said sleeve and said inner and outer rings have about the same radius to form a generally smooth outer surface.

24. The assembly of claim 23 farther including a lower seal located between said outer ring and said inner ring and an upper seal located between said inner ring and said sleeve.

25. The assembly of claim 24 wherein said outer surfaces includes a lower groove and an upper groove shaped to receive said lower and upper seals, respectively.

26. The assembly of claim 25 wherein each groove is smaller than the uncompressed shape of its associated seal such that each seal is compressed when it is received in its associated groove.

27. The assembly of claim 25 wherein a radially inner portion of said inner ring is axially spaced from a radially inner portion of said sleeve to ensure proper compression of said upper seal.

28. The assembly of claim 18 further comprising a lower hub seal located between said outer ring and said sleeve.

29. The assembly of claim 18 wherein said sleeve is welded to said drive shaft.

30. A method for coupling a set of blades to a drive shaft comprising the steps of:

coupling a sleeve having a keyway to said shaft;

locating an upper ring adjacent said sleeve, said upper ring having a set of generally radially extending blades and a keyway;

locating a lower ring adjacent said upper ring, said lower ring having a set of generally radially extending blades and a keyway;

locating a key in said keyways of said upper ring and said lower ring; and coupling a cap to said sleeve, wherein said key rotationally couples said lower ring and said upper ring to one of said cap or said sleeve.

31. The method of claim 30 wherein said sleeve receives said shaft therethrough during said first coupling step, said upper and lower rings receive said shaft therethrough during said first and second locating steps, and said cap receives said shaft therethrough during said second coupling step.

32. An assembly for rotationally coupling a set of blades to a drive shaft comprising:

a sleeve shaped to receive said drive shaft therethrough;

a cap shaped to receive said drive shaft therethrough;

a lower unitary ring shaped to be located generally between said cap and said sleeve, said lower ring having a set of generally radially extending blades; and an upper unitary ring shaped to be located generally between said cap and said sleeve and adjacent to said lower ring, said upper ring having a set of generally radially extending blades, wherein at least one of said sleeve, said cap, said lower ring or unitary ring is shaped to be directly rotationally coupled to said drive shaft, and wherein theothers of said sleeve, said cap, said lower ring or said upper ring that are not directly rotationally coupled to said drive shaft are shaped to be indirectly rotationally coupled to said drive shaft.

33. The assembly of claim 22 wherein said cap is shaped to be threadedly coupled to said sleeve.

34. An impeller assembly comprising:

a rotatable drive shaft;

a sleeve receiving said drive shaft therethrough;

a cap receiving said drive shaft therethrough;

a lower unitary ring located generally between said cap and said sleeve, said lower ring having a set of generally radially extending blades; and an upper unitary ring located generally between said cap and said sleeve and adjacent to said lower ring, said upper ring having a set of generally radially extending blades, wherein at least one of said sleeve, said cap, said lower ring or unitary ring is directly rotationally coupled to said drive shaft, and wherein the others of said sleeve, said cap, said lower ring or said upper ring that are not directly rotationally coupled to said drive shaft are indirectly rotationally coupled to said drive shaft.

35. An assembly for rotationally coupling a set of blades to a drive shaft comprising:

a sleeve shaped to receive said drive shaft therethrough;

a lower ring shaped to receive said drive shaft therethroug, said lower ring having a set of generally radially extending blades; and an upper ring shaped to be located generally between said sleeve and said lower ring, said upper ring being shaped to receive said drive shaft therethrough and having a set of generally radially extending blades, wherein at least one of said sleeve, said lower ring or upper ring is shaped to be directly rotationally coupled to said drive shaft, and wherein the others of said sleeve, said lower ring or said upper ring that are not directly rotationally coupled to said drive shaft are shaped to be indirectly rotationally coupled to said drive shaft, and wherein said lower ring is shaped to be directly axially coupled to said sleeve.

36. The assembly of claim 35 wherein said lower ring is shaped to be threaded onto said sleeve.

37. The assembly of claim 35 wherein each of said upper and lower rings are unitary.

* * * * *

UNITED STATES PATENT AND TRADEMARK OFFICE

CERTIFICATE OF CORRECTION

PATENT NO. : 6,435,832 B1
DATED : August 20, 2002
INVENTOR(S) : Julian B. Fasano It is certified that error appears in the above-identified patent and that said Letters Patent is hereby corrected as shown below:

Column 5,
Line 49, the word “farther” should be -- further --.

Column 6,
Line 13, insert -- directly -- before the words “coupling a cap”.
Line 30, delete “at least one of” before “said sleeve”.
Lines 31-32, delete “, said cap, said lower ring or unitary ring is shaped to be” and insert -- is --.
Line 35, delete “theothers of said sleeve,”.
Lines 36-37, after the word “ring” (first occurrence) change “or” to -- and --; after the word “ring” (second occurrence) delete “that are not directly rotationally coupled to said drive shaft”.
Line 39, “claim 22” should be -- claim 37 --.
Line 51, delete “at least one of” before “said sleeve”.
Lines 51-52, delete “, said cap, said lower ring or unitary ring”.
Lines 53-54, delete “the others of said sleeve,”.
Line 54, after the word “ring” (first occurrence) change “or” to -- and --.
Lines 55-56, delete “that are not directly rotationally coupled to said drive shaft”.
Line 62, “therethroug” should be -- therethrough --.

Column 7,
Lines 1-2, delete “at least one of” before “said sleeve”.
Lines 2-3, delete “, said lower ring or upper ring is shaped to be” and add -- is --.
Line 4, delete “the others of said sleeve”.
Line 5, after “ring” (first occurrence) delete “or” and insert -- and --.
Lines 5-6, delete “that are not directly rotationally coupled to said drive shaft”.

Signed and Sealed this

Seventeenth Day of December, 2002

JAMES E. ROGAN
*Director of the United States Patent and Trademark Office*